United States Patent [19]

Magiera

[11] Patent Number: 5,023,417

[45] Date of Patent: Jun. 11, 1991

[54] SWITCH ASSEMBLY HAVING A ROCKER SWITCH CONNECTED TO A REMOTE ACTUATOR

[76] Inventor: Joseph Magiera, 176 Acorn Ln., Libertyville, Ill. 60048

[21] Appl. No.: 421,147

[22] Filed: Oct. 13, 1989

[51] Int. Cl.[5] ..... H01H 9/22; H01H 3/02; H01H 17/08

[52] U.S. Cl. ..... 200/331; 200/51.0 LM; 200/337; 200/339; 74/96; 74/500.005

[58] Field of Search ..... 200/330, 331, 332, 337, 200/51 LM, 338; 74/96, 500.5, 501.6, 502.4

[56] References Cited

U.S. PATENT DOCUMENTS

| | | | |
|---|---|---|---|
| 2,614,197 | 10/1952 | Lightfoot | 200/331 X |
| 2,646,487 | 7/1953 | Johnson | 200/331 |
| 2,659,791 | 11/1953 | Dickinson | 200/331 X |
| 3,939,725 | 2/1976 | Fisher | 200/331 X |
| 4,347,417 | 8/1982 | Sorenson . | |
| 4,430,534 | 2/1984 | Sorenson . | |
| 4,431,880 | 2/1984 | Ives . | |
| 4,454,400 | 6/1984 | Sorenson . | |
| 4,461,938 | 7/1984 | Sorenson . | |
| 4,488,201 | 12/1984 | Webb et al. . | |
| 4,489,300 | 12/1984 | Hollenstein et al. . | |
| 4,620,077 | 10/1986 | Zdanys Jr. et al. | 200/331 |
| 4,626,638 | 12/1986 | Samples et al. | 200/331 |
| 4,771,145 | 9/1988 | Davis Jr. | 200/331 |
| 4,814,554 | 3/1989 | Magiera . | |

OTHER PUBLICATIONS

"CTS Series 080 AC Switch/Receptacle with Remote Actuator" CTS Corporation, Switch Division, 500 Linne Road, Paso Robles, CA 93446 (4 Pages) (No Date).

*Primary Examiner*—Ernest G. Cusick

*Attorney, Agent, or Firm*—Hill, Van Santen, Steadman and Simpson

[57] ABSTRACT

A switch assembly having an actuator including a body with at least one movable section, a rocker switch having at least one movable cap which is movable to one switch position of at least two switch positions of the rocker switch, an activating assembly having a housing containing at least one movable part contacting the movable cap of the rocker switch and a cable for operationally connecting the movable section of the actuator to the movable cap of the rocker switch. The first end of the cable has an outer sheath removably attached to the body and an inner connector connected to a first end of the movable section. A second end of the cable has the outer sheath removably attached to the housing and has the inner connector connected to a first end of the movable part. When the movable section is moved, the movable cap is changed from one switch position to another switch position via the cable and activating assembly.

13 Claims, 4 Drawing Sheets

SWITCH ASSEMBLY HAVING A ROCKER SWITCH CONNECTED TO A REMOTE ACTUATOR

BACKGROUND OF THE INVENTION

The present invention relates in general to electrical switches and, in particular, to a rocker switch connected to a remote actuator.

Electrical switches operated by remote actuators are well known in the prior art. Such remotely actuated prior art switches utilize push button switches and slide switches which are connected to a first end of a rigid rod. The second end of the rigid rod is connected to an actuating mechanism which is mounted at a location remote from the switch. For connecting the switch to the actuator it is also known to use flexible cables, such as a bowden cable wherein an inner connector rides in an outer sheath. All of these prior art combinations of switches, cables or rods and actuators have relatively complex components.

SUMMARY OF THE INVENTION

It is an object of the present invention to provide an improved electrical switch connected to a remote actuator.

It is a further object of the present invention to provide an electrical switch connected to a remote actuator which has an ease of assembly and a minimal number of components.

It is an additional object of the present invention to provide an electrical switch connected to a remote actuator which provides for ease of assembly and disassembly of the switch and actuator from a connecting cable.

It is another object of the present invention to provide a switch assembly which includes a remote actuator and an electrical rocker switch.

The switch assembly of the present invention has an actuator having a body with at least one movable section. The switch assembly also has a rocker switch having at least one movable cap which is movable to one switch position of at least two switch positions of the rocker switch. An activating assembly is provided which has a housing containing at least one movable part contacting the movable cap of the rocker switch. A means for connecting is provided for joining the movable section of the actuating member to the movable cap of the rocker switch. When the movable section is moved, the movable cap is changed from one switch position to another switch position via the means for connecting and the activating assembly.

In a preferred embodiment the actuator has a body containing the movable section attached thereto at a pivot access. The movable section has a first end removably connected to the means for connecting. The means for connecting in the preferred embodiment is a cable having an outer sheath and an inner connector. A first end of the cable has the outer sheath removably attached to the body and has the inner connector connected to the first end of the movable section. The activating assembly has the housing containing the movable part connected to the outer sheath at a second end of the cable with the movable part having a first end removably attached to the inner connector of the cable.

The activation assembly has a number of different embodiments, but in general has a housing which is attached to the rocker switch. The housing contains an element having an end connected to the inner connector of the cable and has a portion which contacts the movable cap of the rocker switch. As the inner connector of the cable is moved by means of the actuator, the element of the activation assembly moves within the housing and causes the movable cap to move to a different switch position. In an alternative embodiment the means for connecting can be a rigid rod depending upon the application used for the switch assembly.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

FIG. 12 is a schematic representation of an actuator connected to a rocker switch via a flexible cable and an activating assembly according to FIG. 10; and FIG. 13 is a schematic representation of an actuator connected to a rocker switch via a rigid rod and an activating assembly according to FIG. 10.

DESCRIPTION OF THE PREFERRED EMBODIMENT

Figure 2:
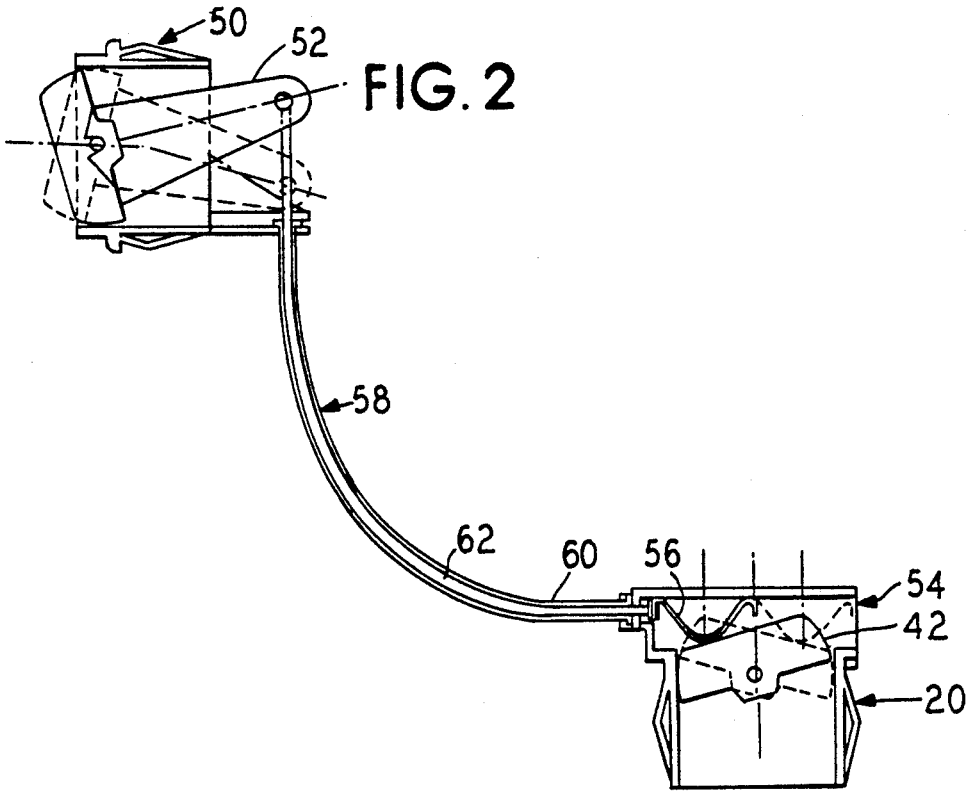
FIG. 2 is a schematic representation of an actuator connected to the rocker switch via a flexible cable and an activating assembly on the rocker switch.

The switch assembly of the present invention has general applicability, but is most advantageously utilized in a combination of a rocker switch activated by an actuator by means of a flexible cable and an activating assembly connected to the rocker switch as shown in particular in FIG. 2.

Figure 1:
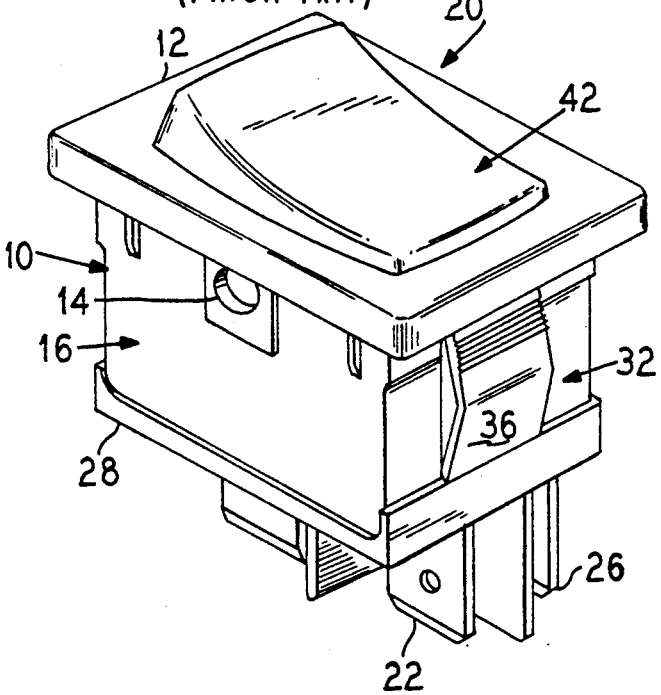
FIG. 1 (PRIOR ART)
FIG. 1 is a perspective view of a rocker switch used in the present invention.

The rocker switch may be any one of a number of different types of rocker switches well known in the prior art. As one example, as shown in FIG. 1, the rocker switch 20 has a housing 10 which has at least an open top 12 and a means for pivoting 14 on two opposing sides 16 thereof. Pairs of electrical contacts, such as electrical contacts 22 and 26, extend from a bottom end 28 of the housing 10. On opposing ends 32 of the housing 10 clips 36 are provided for securing the rocker switch 20 to a panel (not shown). Various other types of structures can be used for securing the rocker switch 20 to a panel. The rocker switch 20 is provided with a movable cap 42 which, as well known in the art, rocks back and forth to switch the electrical contacts contained within the rocker switch 20. Such a rocker switch which can be utilized with the present invention is disclosed in U.S. Pat. No. 4,814,554 (hereby incorporated by reference).

As shown in FIG. 2 the present invention is a switch assembly having a means 50 for actuating having at least one movable section 52. A means for moving or activating assembly 54 is attached to the rocker switch 20. The activating assembly 54 contains an element 56 which contacts the movable cap 42 of the rocker switch 20.

In the preferred embodiment a cable 58 is provided which has an outer sheath 60 and an inner conductor 62. The cable 58 connects the movable section 52 of the means for actuating 50 to the movable part 56 of the activating assembly 54. When the movable section 52 of the means for actuating 50 is moved, the movable cap 42 of the rocker switch 20 changes from one switch position to the other switch position of first and second switch positions via the cable 58 and activating assembly 54 as will be explained in more detail below.

Figure 3:
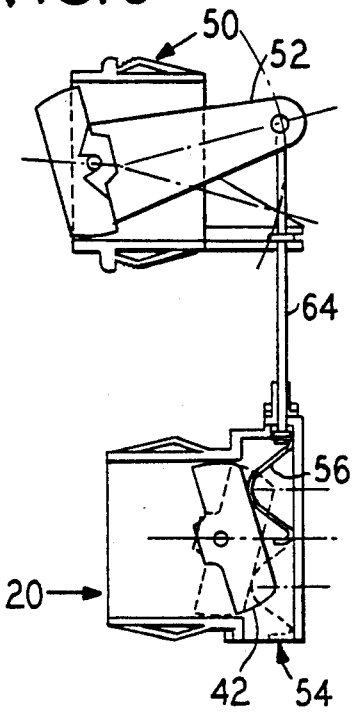
FIG. 3 is a schematic representation of an actuator connected to the rocker switch via a rigid rod and an activating assembly on the rocker switch.

As shown in FIG. 3 in an alternative embodiment the cable 58 may be replaced by a substantially rigid rod 64 for connecting the means for actuating 50 to the activating element 54.

Figure 4:
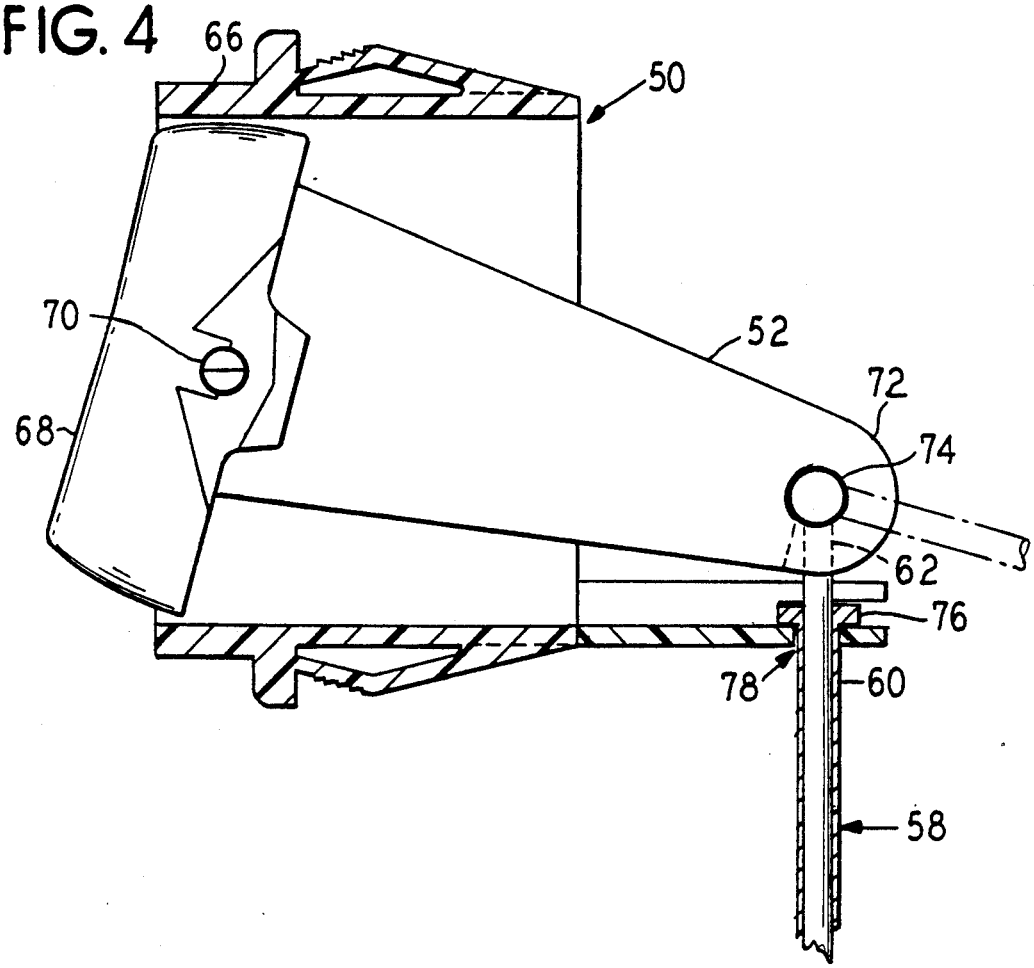
FIG. 4 is a more detailed schematic representation of the actuator used in the present invention.

Referring now to FIG. 4, the means for actuating or actuator 50 in the preferred embodiment has a housing 66 which can have a similar construction to the housing 10 of the rocker switch 20. A movable actuator cap 68 is connected to the movable section 52 and pivots about pivot axis 70. An operator can change the position of the actuator 50, that is by pressing on the up raised portion of the cap 68, in the same manner that the rocker switch 20 is activated.

On a first end 72 of the movable section 52 an end of the inner conductor 62 is attached in a pivotable manner at location 74. The outer sheath 60 of the cable 58 is attached to the housing 66. The flange 76 on the end of the cable 60 allows the cable 60 to be attached to the housing 66 of the actuator 50 without the use of any tools, the housing 66 being provided with a open slot 78 for insertion of the cable 58. Also the end of the inner conductor 62 can have an enlarged portion which fits into an opening in the first end 72 of the movable section 52 at the pivot location 74. Thus, assembly and disassembly of the cable 58 from the actuator 50 is simple and quick and does not require the use of any tools. Various other ways of connecting the cable, both its inner conductor 62 and outer sheath 60, can be envisioned by one skilled in the art. This also applies to the attachment of the rigid rod 64 depicted in FIG. 3.

FIGS. 5-11 show different embodiments of the activating assembly 54 used in the present invention. In general each of the activating assemblies 54 has a housing 80 attached to the rocker switch 20. Housing 80 contains at least one movable part for contacting the movable cap 42 of the rocker switch 20. The cable 58 can have its outer sheath 62 and inner connector 60 connected to the activating assembly 54 in a manner similar to that described for the attachment of the cable 58 to the actuator 50. It is to be appreciated that in general the cable is designed to be attached without the use of any tools and in a simple and quick operation.

Figure 5:
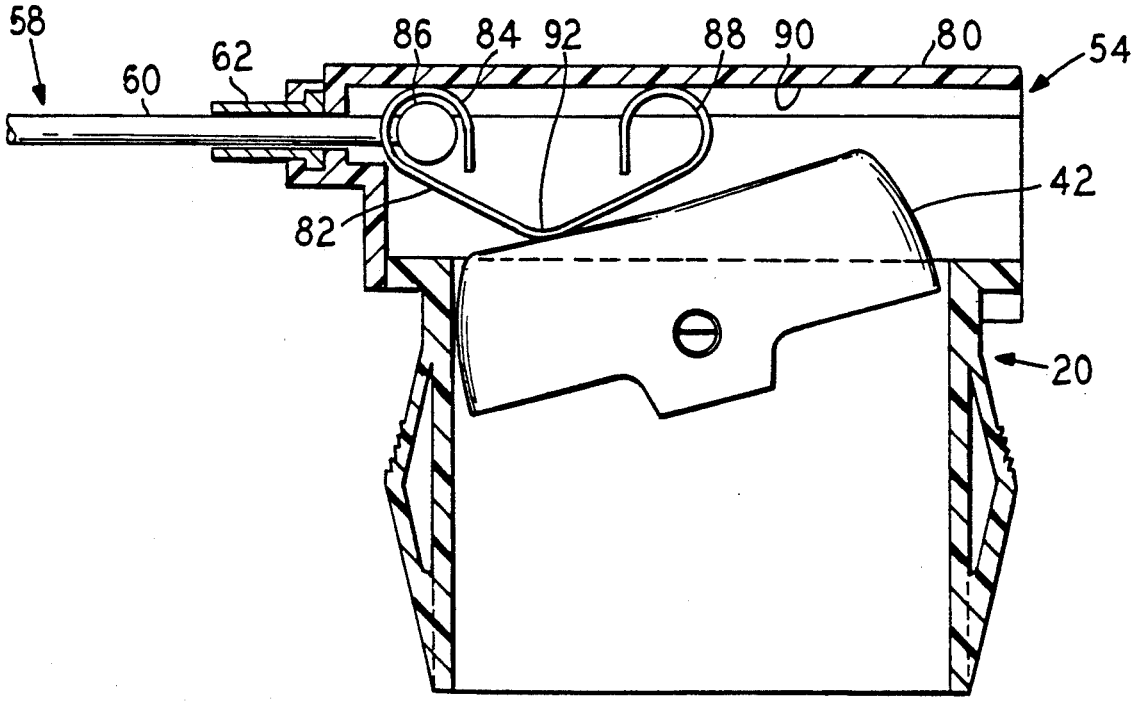
FIG. 5 is a schematic representation of the activating assembly with a flexible V-shaped element.

In the embodiment shown in FIG. 5 the activation assembly 54 has a flexible V-shaped element 82 having a first end 84 connected to an end 86 of the cable 58 and a second end 88 which along with the first end 84 rides against an inside surface 90 of the housing 80. The inside surface 90 is opposed from the movable cap 42 of the rocker switch 20 and an angled area 92 rides against the movable cap 42 of the rocker switch 20. When the cable 58 causes the V-shaped element 82 to move across the top surface of the movable cap 42, the element 82 flexes as it crosses the center area of the movable cap 42, and as it proceeds farther it causes the movable cap 42 to switch to its other switch position.

Figure 6:
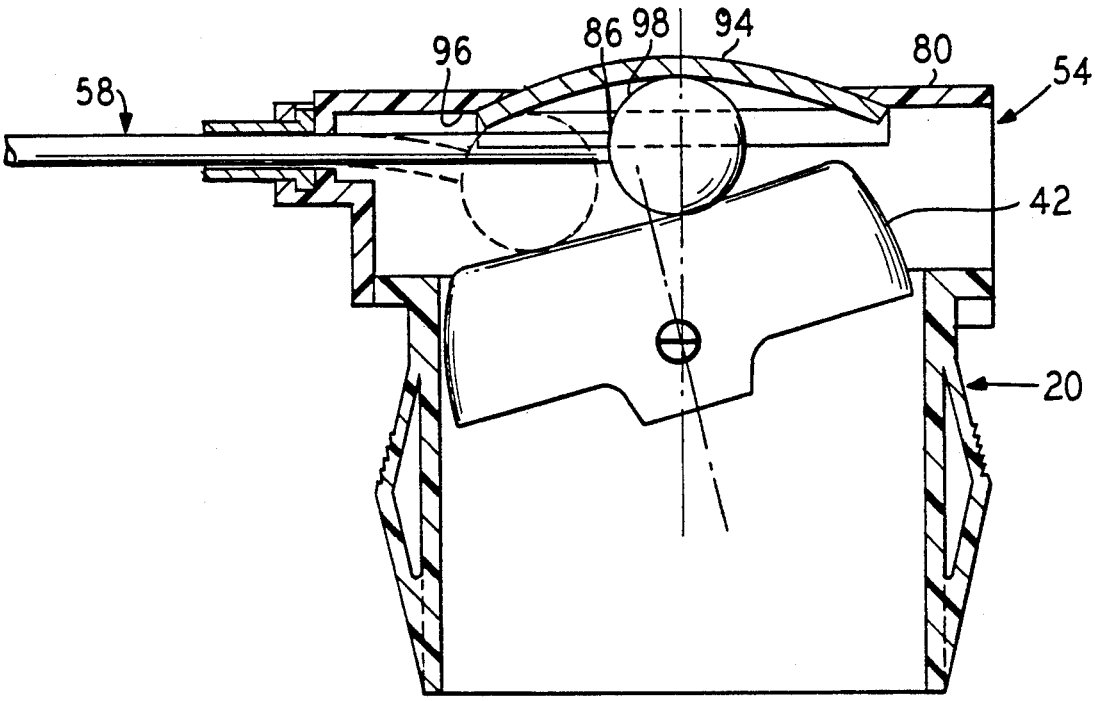
FIG. 6 is a schematic representation of the activating assembly with a flexible area and a spherical element.

Referring now to the embodiment depicted in FIG. 6, the housing 80 of the activating assembly 54 has a flexible area 94 in a side 96 of the housing 80 opposed from the movable cap 42 of the rocker switch 20. The activating assembly 54 also has a substantially spherical element 98 connected to the end 86 of the cable 58. The spherical element 98 is located substantially between the flexible area 94 and the movable cap 42 as shown. As the cable 58 moves the spherical element 98 across a top surface of the cap 42 it causes the cap 42 to change from one switch position to the other switch position and as the spherical element 98 moves across a center portion of a cap 42 the area 94 flexes outward in order to retain tension between the spherical element 98 and the top surface of the cap 42.

Figure 7:
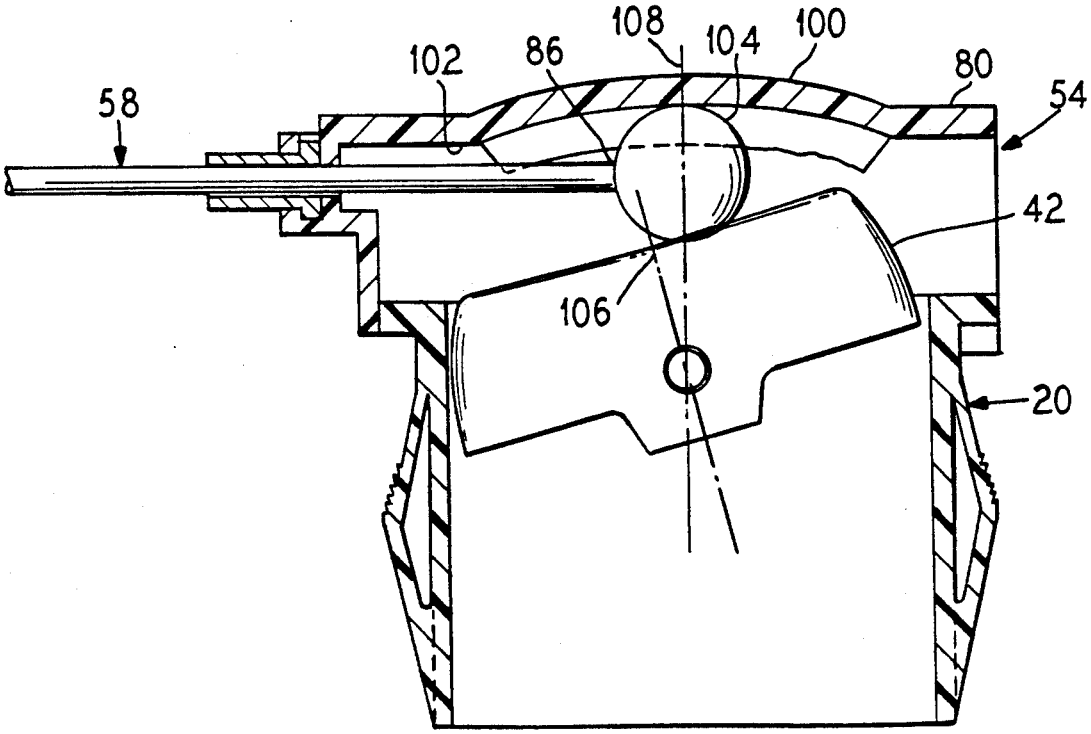
FIG. 7 is a schematic representation of the activating assembly with a curved area and a spherical element.

FIG. 7 shows another alternative embodiment of the present invention and in particular of the activating element 54 which has a substantially curved area 100 in a side 102 of the housing 80 which is opposed from the cap 42 of the rocker switch 20. The activating assembly 54 also includes a substantially spherical element 104 which is attached to an end 86 of the cable 58. The spherical element 104 is substantially located between the curved area 100 of the housing 80 and the top surface of the movable cap 42 of the rocker switch 20. The diameter of the spherical element 104 is substantially equal to the distance from a center 106 of the cap 42 and a center point 108 of the curved area 100. Again as the cable 58 causes the spherical element 104 to move across the cap 42, the cap 42 will change from one switch position to another switch position. The curved area 100 causes a spherical element 104 to remain in contact with the top surface of the cap 42.

Figure 8:
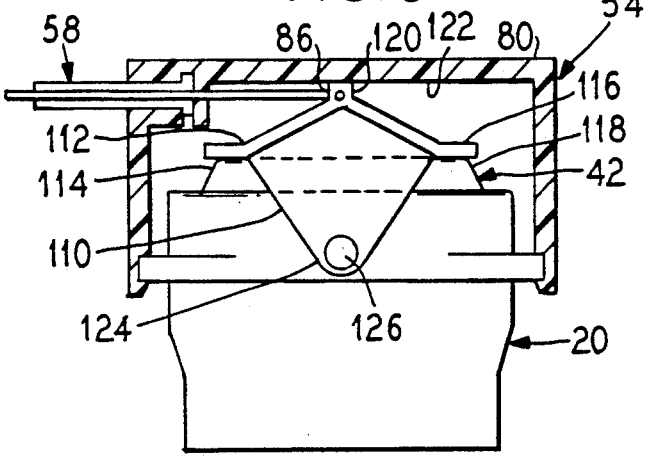
FIG. 8 is a schematic representation of the activating assembly with a diamond shaped element connected to the cable at a raised portion.
Figure 9:
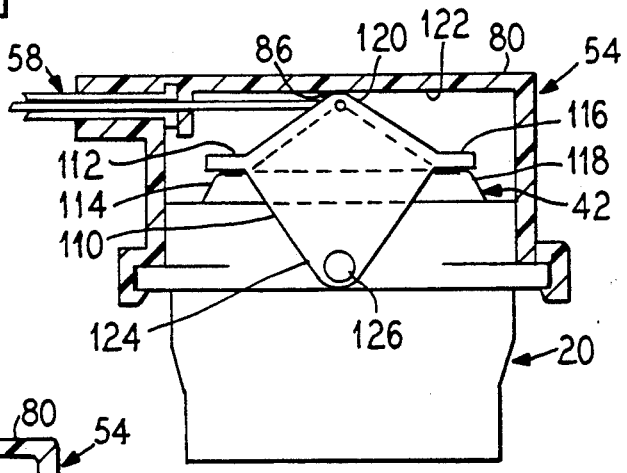
FIG. 9 is a schematic representation of the activating assembly with a diamond shaped element connected to the cable at a corner thereof.

FIGS. 8 and 9 show two further alternative embodiments of the present invention. In both these embodiments the activating assembly 54 has its housing 80 attached to the rocker switch 20. The activating assembly 54 further includes a substantially diamond shaped element 110 which has a first corner 112 contacting a first end 114 of the cap 42, a second corner 116 contacting a second end 118 of the cap 42, a third corner 120 riding against an inside surface 122 of the housing 80, the inside surface 122 being opposed from the cap 42, and a fourth corner 124 pivotably attached to the housing 80 at a point 126 corresponding to the pivot point of the movable cap 42 in the rocker switch 20. The third corner 120 is attached to the end 86 of the cable 58. Also the first and second corners 114, 116 are opposed, and the third and fourth corners 120, 124 are opposed as shown in FIGS. 8 and 9. The differences between the embodiments of FIGS. 8 and 9 is that in FIG. 8 the end 86 of the cable 58 is connected to a slightly up raised portion on the corner 120 and in FIG. 9 it is connected directly to the corner 120.

Figure 10:
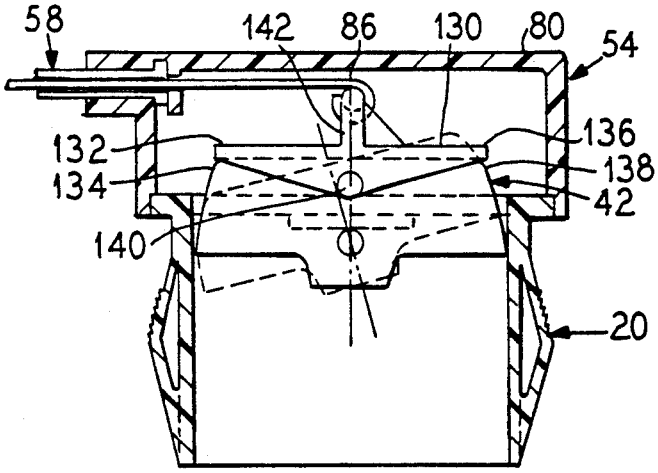
FIG. 10 is a schematic representation of the activating assembly with a triangular shaped element.

As further shown in an alternative embodiment of FIG. 10 the housing 80 of the activating assembly 54 contains a substantially triangular shaped element 130 having a first end 132 contacting a first end 134 of the movable cap 42 and a second end 136 contacting a second end 138 of the movable cap 42. A third end 140 is pivotably attached to the housing 80 and the element 130 also has an arm 142 opposed from the third end 140 and is attached to the end 86 of the cable 58. As the cable 58 is moved the element 130 pivots at the third corner 140 causing the movable cap 42 to change from one switch position to another switch position.

Figure 11:
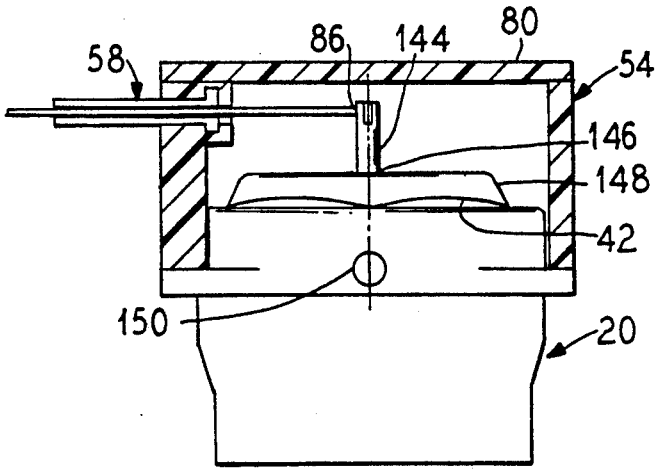
FIG. 11 is a schematic representation of the activating assembly with an armature.

In a final embodiment depicted in FIG. 11 the activating assembly 54 has the housing 80 attached to the rocker switch 20 and the cable 58 has an end 86 attached to an armature element 144 which is connected to substantially a center area 146 of the movable cap 42. The armature 144 can be connected directly to the movable cap 42 or as shown in FIG. 11 can be attached to a plate 148 which in turn is attached to the cap 42. As the cable 58 causes the armature 144 to move the cap 42 will pivot about the pivot point 150 and change from one switch position to another switch position.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A switch assembly comprising:

means for actuating having at least one movable section;

rocker switch means for electrical switching having at least one movable cap which is movable from at least a first switch position to a second switch position;

means for moving said at least one movable cap of said rocker switch means, said means for moving having a housing attached to said rocker switch means, said at least one movable cap having first and second ends and said housing containing a substantially triangular shaped element having a first end contacting said first end of said at least one movable cap, a second end contacting said second end of said at least one movable cap, and a third end pivotally attached to said housing, said triangular shaped element also having an arm opposed from said third end; and means for connecting said at least one movable section of said means for actuating to said arm of said triangular shaped element;

wherein, when said at least one movable section of said means for actuating is moved, said at least one movable cap of said rocker switch means changes from said first switch position to said second switch position and vice-versa via said means for connecting and said means for moving.

2. The switch assembly according to claim 1, wherein said means for actuating comprises a body containing said at least one movable section attached thereto at a pivot axis, said at least one movable section having a first end removably connected to said means for connecting.

3. The switch assembly according to claim 2, wherein said means for connecting is a cable having an outer sheath and an inner connector, a first end of said cable having said outer sheath removably attached to said body and having said inner connector connected to said first end of said at least one movable section.

4. The switch assembly according to claim 3, wherein a second end of said cable has said outer sheath removably attached to said housing and has said inner connector connected to said arm of said triangular shaped element.

5. The switch assembly according to claim 1, wherein said means for connecting is a cable having an outer sheath and an inner connector.

6. The switch assembly according to claim 1, wherein said means for connecting is substantially a rigid rod.

7. A switch assembly comprising:

an actuator having a body with at least one movable section;

a rocker switch having at least one movable cap which is movable at least two switch positions of said rocker switch, said at least one movable cap having a first end and a second end;

an activating assembly having a housing attached to said rocker switch, said housing containing a substantially triangular shaped element having a first end contacting said first end of said at least one movable cap, a second end contacting said second end of said at least one movable cap, and a third end pivotally attached to said housing, said triangular shaped element also having an arm opposed from said third end; and means for connecting said at least one movable section of said actuating member to said arm of said triangular shaped element;

wherein, when said at least one movable section is moved, said at least one movable cap is changed from said first switch position to said second switch position or vice-versa via said means for connecting and said activating assembly.

8. The switch assembly according to claim 7, wherein said actuator has said body containing said at least one movable section attached thereto at a pivot axis, said at least one movable section having a first end removably connected to said means for connecting.

9. The switch assembly according to claim 8, wherein said means for connecting is a cable having an outer sheath and an inner connector, a first end of said cable having said outer sheath removably attached to said body and having said inner connector to said first end of said at least one movable section.

10. The switch assembly according to claim 9, wherein a second end of said cable has said outer sheath removably attached to said housing and has said inner connector connected to said arm of said triangular shaped element.

11. The switch assembly according to claim 1, wherein said means for connecting is a cable having an outer sheath and an inner connector.

12. The switch assembly according to claim 7, wherein said means for connecting is substantially a rigid rod.

13. A switch assembly comprising:

an actuator having a body with at least one movable section;

a rocker switch having at least one movable cap which is movable between at least two switch positions of said rocker switch, said at least one movable cap having a first end and a second end;

an activating assembly having a housing attached to said rocker switch, said housing containing a substantially triangular shaped element having a first end contacting said first end of said at least one movable cap, a second end contacting said second end of said at least one movable cap, and a third end pivotally attached to said housing said triangular shaped element also having an arm opposed from said third end; and a cable having an outer sheath and an inner connector for operationally connecting said at least one movable section of said actuator to said at least one movable cap of said rocker switch, a first end of said cable having said outer sheath removably attached to said body and having said inner connector connected to said first end of said at least one movable section and a second end of said cable having said outer sheath removably attached to said housing and having said inner connector connected to said arm of said triangular shaped element;

wherein when said at least one movable section is moved, said at least one movable cap is changed from said first switch position to said second switch position or vice-versa via said cable and said activating assembly.

* * * * *